US009163488B2

(12) United States Patent
Tips et al.

(10) Patent No.: US 9,163,488 B2
(45) Date of Patent: Oct. 20, 2015

(54) MULTIPLE ZONE INTEGRATED INTELLIGENT WELL COMPLETION

(71) Applicant: HALLIBURTON ENERGY SERVICES, INC., Houston, TX (US)

(72) Inventors: Timothy R. Tips, Montgomery, TX (US); William M. Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/950,674

(22) Filed: Jul. 25, 2013

(65) Prior Publication Data

US 2014/0083690 A1 Mar. 27, 2014

Related U.S. Application Data

(63) Continuation of application No. PCT/US2012/057215, filed on Sep. 26, 2012.

(51) Int. Cl.
*E21B 34/10* (2006.01)
*E21B 43/08* (2006.01)
(Continued)

(52) U.S. Cl.
CPC ..... *E21B 43/12* (2013.01); *E21B 34/10* (2013.01); *E21B 43/08* (2013.01); *E21B 43/14* (2013.01); *E21B 47/102* (2013.01)

(58) Field of Classification Search
CPC ..... E21B 43/08; E21B 34/10; E21B 43/12
USPC ..... 166/50, 227
See application file for complete search history.

(56) References Cited

U.S. PATENT DOCUMENTS 4,615,388 A 10/1986 Walhaug et al.
4,628,995 A 12/1986 Young et al.
(Continued)

FOREIGN PATENT DOCUMENTS

WO 03080993 A 10/2003
WO 2005045174 A2 5/2005
WO 2012/112657 A2 8/2012

OTHER PUBLICATIONS

Search Report issued Apr. 25, 2013 for International Application Serial No. PCT/US12/57215, 6 pages.
(Continued)

*Primary Examiner* — Brad Harcourt
(74) *Attorney, Agent, or Firm* — Scott Richardson; Baker Botts L.L.P.

(57) ABSTRACT

A system for use with a well having multiple zones can include multiple well screens which filter fluid flowing between a completion string and respective ones of the zones, at least one optical waveguide which senses at least one property of the fluid as it flows between the completion string and at least one of the zones, multiple flow control devices which variably restrict flow of the fluid through respective ones of the well screens, and multiple pressure sensors which sense pressure of the fluid which flows through respective ones of the well screens. A completion string for use in a subterranean well can include at least one well screen, at least one flow control device which selectively prevents and permits substantially unrestricted flow through the well screen, and at least one other flow control device which is remotely operable, and which variably restricts flow through the well screen.

14 Claims, 10 Drawing Sheets

(51) Int. Cl.

| | |
|---|---|
| ***E21B 43/12*** | (2006.01) |
| ***E21B 43/14*** | (2006.01) |
| ***E21B 47/10*** | (2012.01) |

(56) References Cited

U.S. PATENT DOCUMENTS

| | | | | |
|---|---|---|---|---|
| 4,678,035 | A | 7/1987 | Goldschild | |
| 4,806,928 | A | 2/1989 | Veneruso | |
| 4,949,788 | A * | 8/1990 | Szarka et al. | 166/285 |
| 5,547,029 | A | 8/1996 | Rubbo et al. | |
| 5,921,318 | A | 7/1999 | Ross | |
| 6,247,536 | B1 | 6/2001 | Leismer et al. | |
| 6,253,857 | B1 | 7/2001 | Gano | |
| 6,257,332 | B1 | 7/2001 | Vidrine et al. | |
| 6,257,338 | B1 | 7/2001 | Kilgore | |
| 6,446,729 | B1 | 9/2002 | Bixenman et al. | |
| 6,523,609 | B1 | 2/2003 | Miszewski | |
| 6,575,237 | B2 | 6/2003 | Purkis et al. | |
| 6,629,564 | B1 | 10/2003 | Ramakrishnan et al. | |
| 6,655,452 | B2 | 12/2003 | Zillinger | |
| 6,684,951 | B2 | 2/2004 | Restarick et al. | |
| 6,712,149 | B2 | 3/2004 | Leismer et al. | |
| 6,983,796 | B2 | 1/2006 | Bayne et al. | |
| 7,055,598 | B2 | 6/2006 | Ross et al. | |
| 7,165,892 | B2 | 1/2007 | Grigsby et al. | |
| 7,222,676 | B2 | 5/2007 | Patel et al. | |
| 7,228,912 | B2 | 6/2007 | Patel et al. | |
| 7,273,106 | B2 | 9/2007 | Huckabee et al. | |
| 7,278,486 | B2 | 10/2007 | Alba et al. | |
| 7,306,043 | B2 * | 12/2007 | Toekje et al. | 166/375 |
| 7,377,321 | B2 | 5/2008 | Rytlewski | |
| 7,428,932 | B1 | 9/2008 | Wintill et al. | |
| 7,735,555 | B2 | 6/2010 | Patel et al. | |
| 7,900,705 | B2 | 3/2011 | Patel | |
| 7,950,454 | B2 | 5/2011 | Patel et al. | |
| 7,950,461 | B2 | 5/2011 | Schrader et al. | |
| 7,966,875 | B2 | 6/2011 | Proett et al. | |
| 8,079,419 | B2 | 12/2011 | Richards | |
| 8,082,998 | B2 | 12/2011 | Richards | |
| 2003/0079878 | A1 | 5/2003 | Pramann et al. | |
| 2003/0221829 | A1 * | 12/2003 | Patel et al. | 166/278 |
| 2003/0226665 | A1 | 12/2003 | Jones et al. | |
| 2004/0035591 | A1 | 2/2004 | Echols | |
| 2004/0173363 | A1 | 9/2004 | Navarro-Sorroche | |
| 2004/0262011 | A1 | 12/2004 | Huckabee et al. | |
| 2006/0196660 | A1 | 9/2006 | Patel | |
| 2007/0235185 | A1 | 10/2007 | Patel et al. | |
| 2008/0257544 | A1 | 10/2008 | Thigpen et al. | |
| 2009/0188665 | A1 | 7/2009 | Tubel et al. | |
| 2009/0260835 | A1 | 10/2009 | Malone | |
| 2009/0283272 | A1 | 11/2009 | Amaral et al. | |
| 2009/0288824 | A1 | 11/2009 | Fowler, Jr. et al. | |
| 2010/0038093 | A1 | 2/2010 | Patel | |
| 2010/0139909 | A1 | 6/2010 | Tirado et al. | |
| 2010/0175894 | A1 | 7/2010 | Debard et al. | |
| 2010/0193182 | A1 | 8/2010 | Levy | |
| 2010/0212963 | A1 | 8/2010 | Gopalan et al. | |
| 2010/0243270 | A1 | 9/2010 | Ingram et al. | |
| 2011/0011577 | A1 * | 1/2011 | Dusterhoft et al. | 166/212 |
| 2011/0024105 | A1 | 2/2011 | Hammer et al. | |
| 2011/0061862 | A1 | 3/2011 | Loretz et al. | |
| 2011/0061875 | A1 | 3/2011 | Tips et al. | |
| 2011/0108287 | A1 | 5/2011 | Richards | |
| 2011/0120726 | A1 | 5/2011 | Murray et al. | |
| 2011/0132601 | A1 | 6/2011 | Pettinato et al. | |
| 2011/0209873 | A1 | 9/2011 | Stout | |
| 2011/0214883 | A1 * | 9/2011 | Patel | 166/378 |
| 2012/0024520 | A1 | 2/2012 | Fripp et al. | |
| 2012/0181043 | A1 | 7/2012 | Patel | |
| 2012/0181045 | A1 | 7/2012 | Thomas et al. | |
| 2012/0199346 | A1 | 8/2012 | Patel et al. | |
| 2012/0222860 | A1 | 9/2012 | Kalman et al. | |
| 2012/0325484 | A1 | 12/2012 | Patel | |

OTHER PUBLICATIONS

Written Opinion issued Apr. 25, 2013 for International Application Serial No. PCT/US12/57215, 6 pages.

Office Action issued Oct. 4, 2013 for U.S. Appl. No. 13/913,111, 23 pages.

Specification and Drawings for U.S. Appl. No. 13/913,111, filed Jun. 7, 2013, 47 pages.

International Search Report with Written Opinion issued Apr. 8, 2013 for PCT Patent Application No. PCT/US2012/057220, 12 pages.

International Search Report with Written Opinion issued Apr. 25, 2013 for PCT Patent Application No. PCT/US2012/057215, 12 pages.

Halliburton Energy Services, Inc.; "Sand Control Systems", H06382, dated Jul. 2009, 6 pages.

Halliburton Energy Services, Inc.; "IV Series Interval Control Valves", H06972, dated Aug. 2009, 2 pages.

Halliburton Energy Services, Inc.; "Scrams", H06976, Feb. 2012, 2 pages.

Halliburton Energy Services, Inc.; "Long Space-Out Travel Joint (LSOTJ)", H08460, dated Dec. 2011, 2 pages.

Office Action issued Feb. 10, 2014 for U.S. Appl. No. 13/913,111, 21 pages.

Search Report and Written Opinion cited in International Application No. PCT/US2012/057257 dated Apr. 23, 2013.

Search Report and Written Opinion cited in International Application No. PCT/US2012/057283 dated Apr. 23, 2013.

Search Report and Written Opinion cited in International Application No. PCT/US2012/057241 dated Apr. 29, 2013.

Search Report and Written Opinion cited in International Appl. No. PCT/US2012/057231 dated Apr. 23, 2013.

Office Action issued Jun. 19, 2014 in U.S. Appl. No. 13/979,137, 10 pages.

Specification and Drawings for PCT Patent App. No. PCT/US12/57266, filed Sep. 26, 2012, 42 pages.

Specification and Drawings for PCT Patent App. No. PCT/US12/57271, filed Sep. 26, 2012, 40 pages.

Office Action issued May 6, 2014 in U.S. Appl. No. 13/988,099, 17 pages.

Office Action issued Oct. 4, 2013 in U.S. Appl. No. 13/918,077, 15 pages.

Specification and Drawings for PCT Patent App. No. PCT/US12/57278, filed Sep. 26, 2012, 42 pages.

Mazerov, "GOM Completions: Innovation Filling in Technology Gaps at Nearly Six Miles Under," reprinted from the May/Jun. 2009 edition of Drilling Contractor Magazine.

Specification and Drawings filed Jul. 10, 2013 for U.S. Appl. No. 13/939,163, 60 pages.

Specification and Drawings filed Jul. 10, 2013 for U.S. Appl. No. 13/979,137, 42 pages.

Specification and Drawings filed Sep. 5, 2013 for U.S. Appl. No. 14/003,451, 52 pages.

Search Report and Written Opinion cited in International Appl. No. PCT/US2012/057271 dated Apr. 26, 2013.

Search Report and Written Opinion cited in International Appl. No. PCT/US2012/057278 dated May 8, 2013.

Office Action issued Apr. 15, 2014 in U.S. Appl. No. 13/913,111, 22 pages.

Office Action issued Apr. 10, 2014 in U.S. Appl. No. 13/918,077, 26 pages.

Office Action issued May 28, 2014 in U.S. Appl. No. 13/894,830, 24 pages.

Office Action issued Apr. 30, 2014 in U.S. Appl. No. 13/988,139, 14 pages.

Office Action issued Apr. 2, 2014 in U.S. Appl. No. 13/896,887, 7 pages.

* cited by examiner

MULTIPLE ZONE INTEGRATED INTELLIGENT WELL COMPLETION

CROSS-REFERENCE TO RELATED APPLICATION

This application is a continuation under 35 USC 120 of International Application No. PCT/US12/57215, filed on 26 Sep. 2012. The entire disclosure of this prior application is incorporated herein by this reference.

BACKGROUND

This disclosure relates generally to equipment utilized and operations performed in conjunction with subterranean wells and, in one example described below, more particularly provides a multiple zone integrated intelligent well completion.

Where multiple zones are to be produced (or injected) in a subterranean well, it can be difficult to determine how fluids communicate between an earth formation and a completion string in the well. This can be particularly difficult where the fluids produced from the multiple zones are commingled in the completion string, or where the same fluid is injected from the well into the multiple zones.

Therefore, it will be appreciated that improvements are continually needed in the arts of constructing and operating well completion systems.

SUMMARY

In this disclosure, systems and methods are provided which bring improvements to the arts of constructing and operating well completion systems. One example is described below in which a variable flow restricting device is configured to receive fluid which flows through a well screen. Another example is described below in which an optical waveguide is positioned external to a completion string, and one or more pressure sensors sense pressure internal and/or external to the completion string.

A system for use with a subterranean well having multiple earth formation zones is provided to the art by the disclosure below. In one example, the system can include multiple well screens which filter fluid flowing between a completion string in the well and respective ones of the multiple zones, at least one optical waveguide which senses at least one property of the fluid as it flows between the completion string and at least one of the zones, multiple flow control devices which variably restrict flow of the fluid through respective ones of the multiple well screens, and multiple pressure sensors which sense pressure of the fluid which flows through respective ones of the multiple well screens.

A completion string for use in a subterranean well is also described below. In one example, the completion string can include at least one well screen, at least one flow control device which selectively prevents and permits substantially unrestricted flow through the well screen, and at least one other flow control device which is remotely operable, and which variably restricts flow through the well screen.

Also described below is a method of operating a completion string in a subterranean well. In one example, the method comprises: a) closing all of multiple flow control devices connected in the completion string, the completion string including multiple well screens which filter fluid flowing between the completion string and respective ones of multiple earth formation zones, at least one optical waveguide which senses at least one property of the fluid as it flows between the completion string and at least one of the zones, the multiple flow control devices which variably restrict flow of the fluid through respective ones of the multiple well screens, and multiple pressure sensors which sense pressure of the fluid which flows through respective ones of the multiple well screens; b) at least partially opening a selected one of the flow control devices; and c) measuring a change in the property sensed by the optical waveguide and a change in the pressure of the fluid as a result of the opening of the selected one of the flow control devices.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
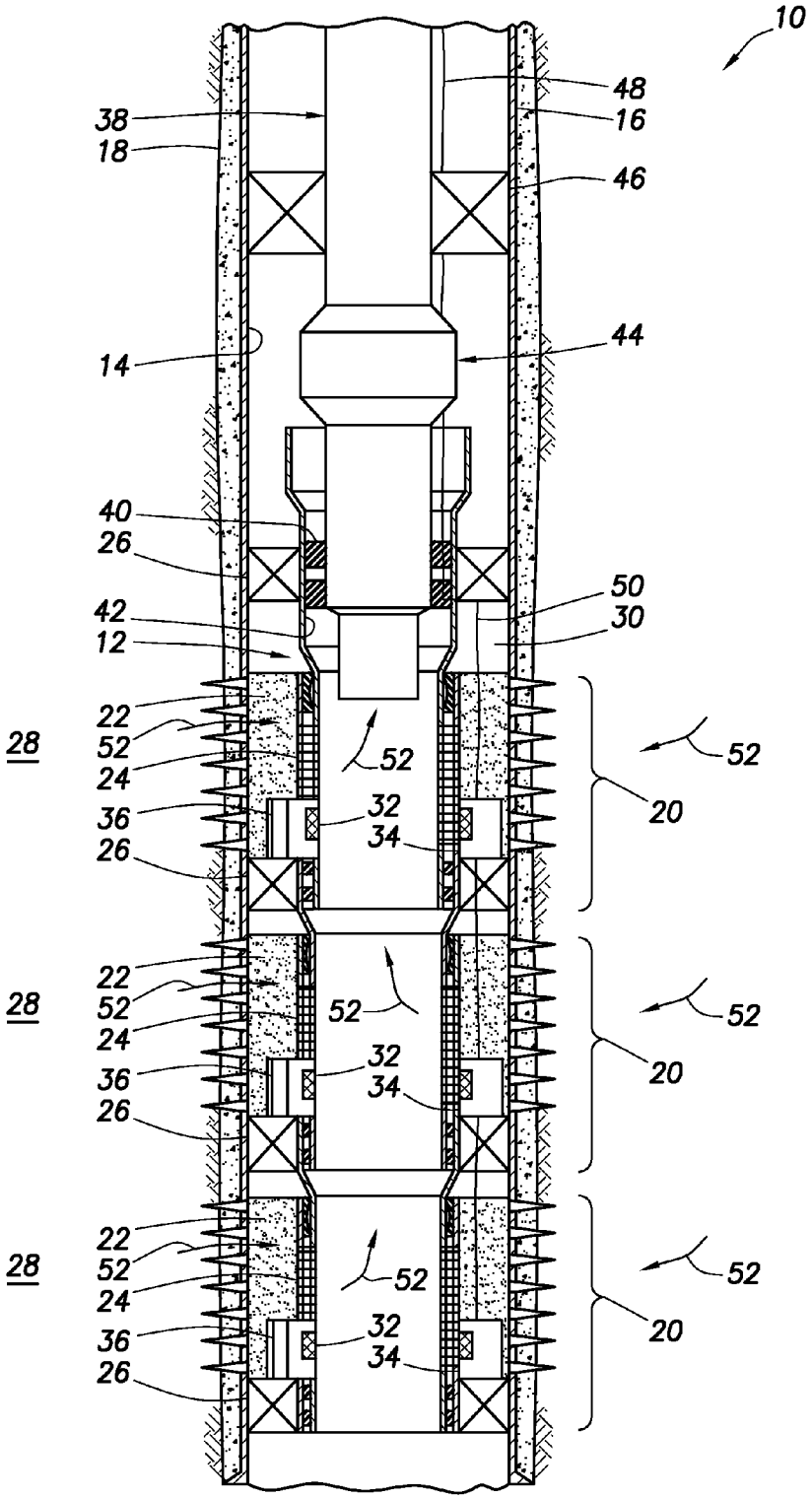
FIG. 1 is a representative partially cross-sectional view of a well system and associated method which can embody principles of this disclosure.

Representatively illustrated in FIG. 1 is a well completion system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a completion string 12 has been installed in a wellbore 14 lined with casing 16 and cement 18. In other examples, the wellbore 14 could be at least partially uncased or open hole.

The completion string 12 includes multiple sets 20 of completion equipment. In some examples, all of the sets 20 of completion equipment can be conveyed into the well at the same time, and gravel 22 can be placed about well screens 24 included in the completion equipment, all in a single trip into the wellbore 14.

For example, a system and technique which can be used for installing multiple sets of completion equipment and gravel packing about well screens of the completion equipment is marketed by Halliburton Energy Services, Inc. of Houston, Tex. USA as the ENHANCED SINGLE TRIP MULTI- ZONE™ system, or ESTMZ™. However, other systems and techniques may be used, without departing from the principles of this disclosure.

Packers 26 are used to isolate multiple earth formation zones 28 from each other in the wellbore 14. The packers 26 seal off an annulus 30 formed radially between the completion string 12 and the wellbore 14.

Also included in each set 20 of completion equipment is a flow control device 32 and a hydraulic control device 34 which controls hydraulic actuation of the flow control device. A suitable flow control device, which can variably restrict flow into or out of the completion string 12, is the infinitely variable interval control valve IV-ICV™ marketed by Halliburton Energy Services, Inc. A suitable hydraulic control device for controlling hydraulic actuation of the IV-ICV™ is the surface controlled reservoir analysis and management system, or SCRAMS™, which is also marketed by Halliburton Energy Services.

In each completion equipment set 20, a pressure sensor 36 is included for sensing pressure internal and/or external to the completion string 12. The pressure sensor 36 could be provided as part of the hydraulic control device 34 (such as, part of the SCRAMS™ device), or a separate pressure sensor may be used. If a separate pressure sensor 36 is used, a suitable sensor is the ROC™ pressure sensor marketed by Halliburton Energy Services, Inc.

After the gravel packing operation is completed, a gravel packing work string and service tool (not shown) used to convey the completion string 12 into the well is retrieved, and a production string 38 is lowered into the wellbore 14 and stabbed into the completion string 12. The production string 38 in this example includes seals 40 for sealingly engaging a seal bore 42 in an uppermost one of the packers 26, an expansion joint 44 for convenient spacing out to a tubing hanger in a wellhead (not shown), and a packer 46.

The expansion joint 44 may be similar to a Long Space Out Travel Joint, or LSOTJ™, marketed by Halliburton Energy Services, Inc., except that provision is made for extending the lines 48 across the expansion joint. Preferably, the seals 40 are stabbed into the seal bore 42, and then the expansion joint 44 is actuated to allow it to compress, so that proper spacing out is achieved for landing a wellhead above. The packer 46 is then set, for example, by applying pressure to one of the hydraulic lines 48.

Figure 7:
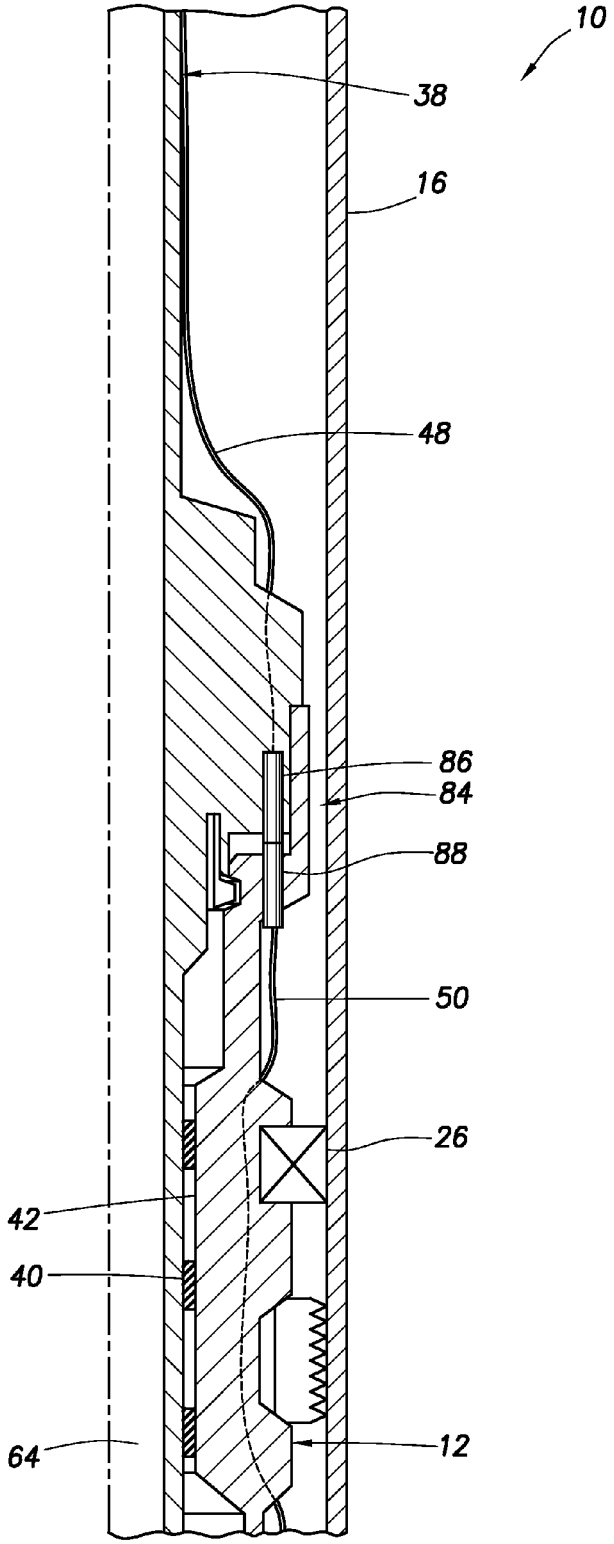
FIG. 7 is a representative cross-sectional view of a wet connection which may be used in the well system and method.

When the production string 38 is landed in the completion string 12, a wet connection is made between lines 48 carried on the production string and lines 50 carried on the completion string. Preferably, the lines 48, 50 each include one or more electrical, hydraulic and optical lines (e.g., at least one optical waveguide, such as, an optical fiber, optical ribbon, etc.). An example of such a wet connection is depicted in FIG. 7, and is described more fully below.

In the FIG. 1 example, the lines 48, 50 are depicted as being external to the production string 38 and completion string 12, respectively, but in other examples all or part of the lines could be positioned internal to the production and/or completion string, or in a wall of the production and/or completion string. The scope of this disclosure is not limited to any particular locations of the lines 48, 50.

Preferably, the optical waveguide(s) is/are external to the completion string 12 (for example, between the well screens 24 and the wellbore 14), so that properties of fluid 52 which flows between the zones 28 and the interior of the completion string 12 can be readily detected by the optical waveguide(s). In other examples, the optical waveguide could be positioned in a wall of the casing 16, external to the casing, in the cement 18, etc.

Preferably, the optical waveguide is capable of sensing temperature and/or pressure of the fluid 52. For example, the optical waveguide may be part of a distributed temperature sensing (DTS) system which detects Rayleigh backscattering in the optical waveguide as an indication of temperature along the waveguide. For pressure sensing, the optical waveguide could be equipped with fiber Bragg gratings and/or Brillouin backscattering in the optical waveguide could be detected as an indication of strain (resulting from pressure) along the optical waveguide. However, the scope of this disclosure is not limited to any particular technique for sensing any particular property of the fluid 52.

The fluid 52 is depicted in FIG. 1 as flowing from the zones 28 into the completion string 12, as in a production operation. However, the principles of this disclosure are also applicable to situations (such as, acidizing, fracturing, other stimulation operations, conformance or other injection operations, etc.), in which the fluid 52 is injected from the completion string 12 into one or more of the zones 28.

In one method, all of the flow control devices 32 can be closed, to thereby prevent flow of the fluid 52 through all of the screens 24, and then one of the flow control devices can be opened to allow the fluid to flow through a corresponding one of the screens. In this manner, the properties of the fluid 52 which flows between the respective zone 28 and through the respective well screen 24 can be individually detected by the optical waveguide. The pressure sensors 36 can meanwhile detect internal and/or external pressures longitudinally distributed along the completion string 12, and this will provide an operator with significant information on how and where the fluid 52 flows between the zones 28 and the interior of the completion string.

This process can be repeated for each of the zones 28 and/or each of the sets 20 of completion equipment, so that the fluid 52 characteristics and flow paths can be accurately modeled along the completion string 12. Water or gas encroachment, water or steam flood fronts, etc., in individual zones 28 can also be detected using this process.

Figure 2A:
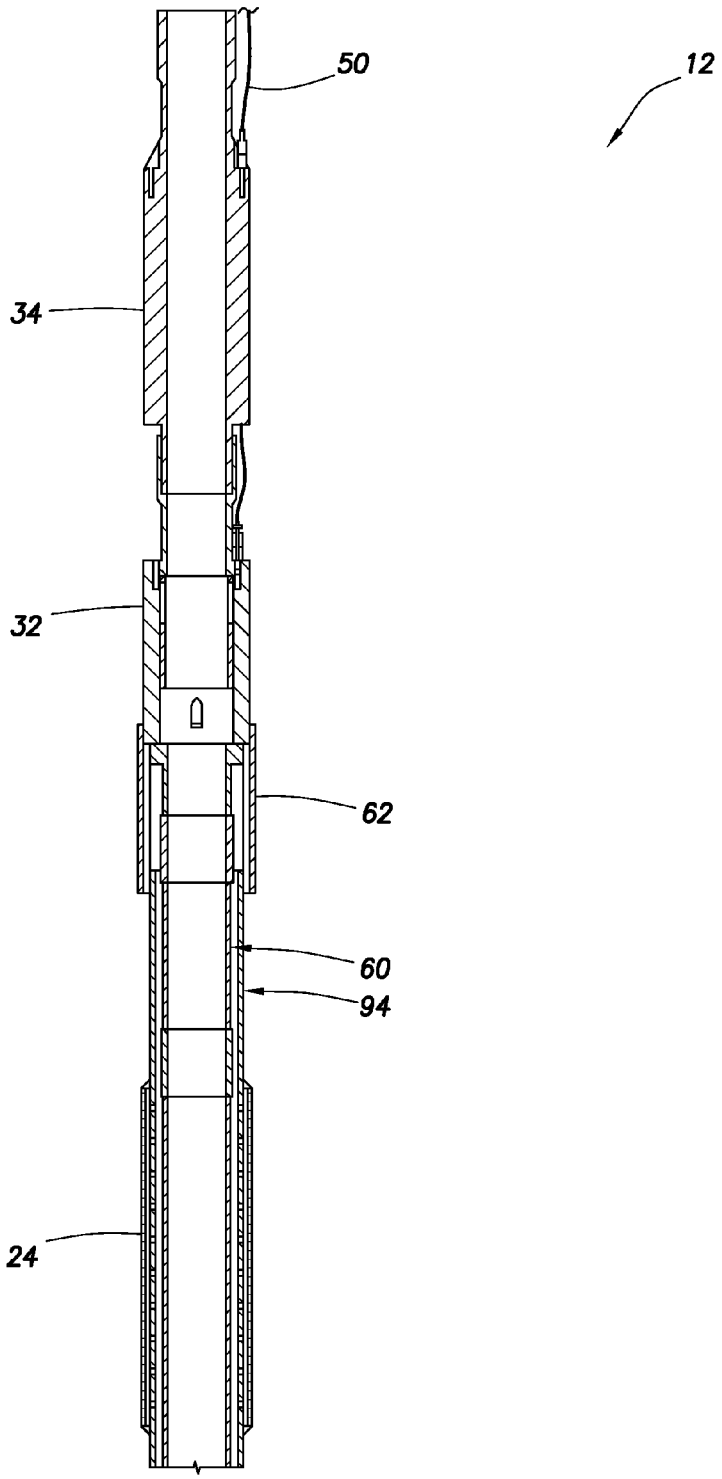
FIGS. 2A-C are representative cross-sectional views of successive longitudinal sections of a completion string which may be used in the well system and method of FIG. 1, and which can embody principles of this disclosure.
Figure 2B:
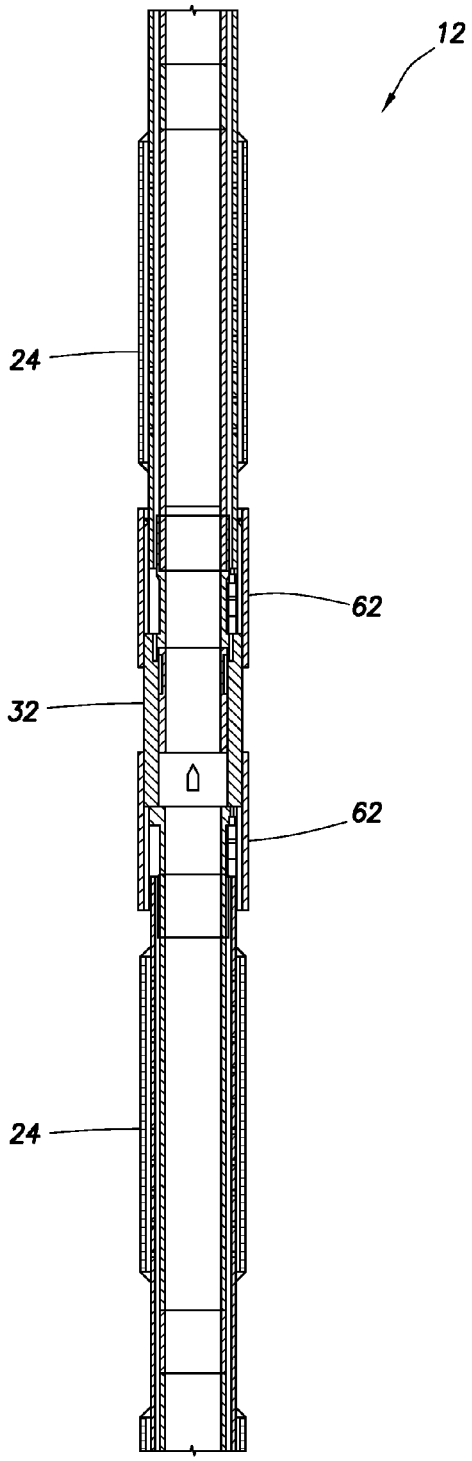
Figure 2C:
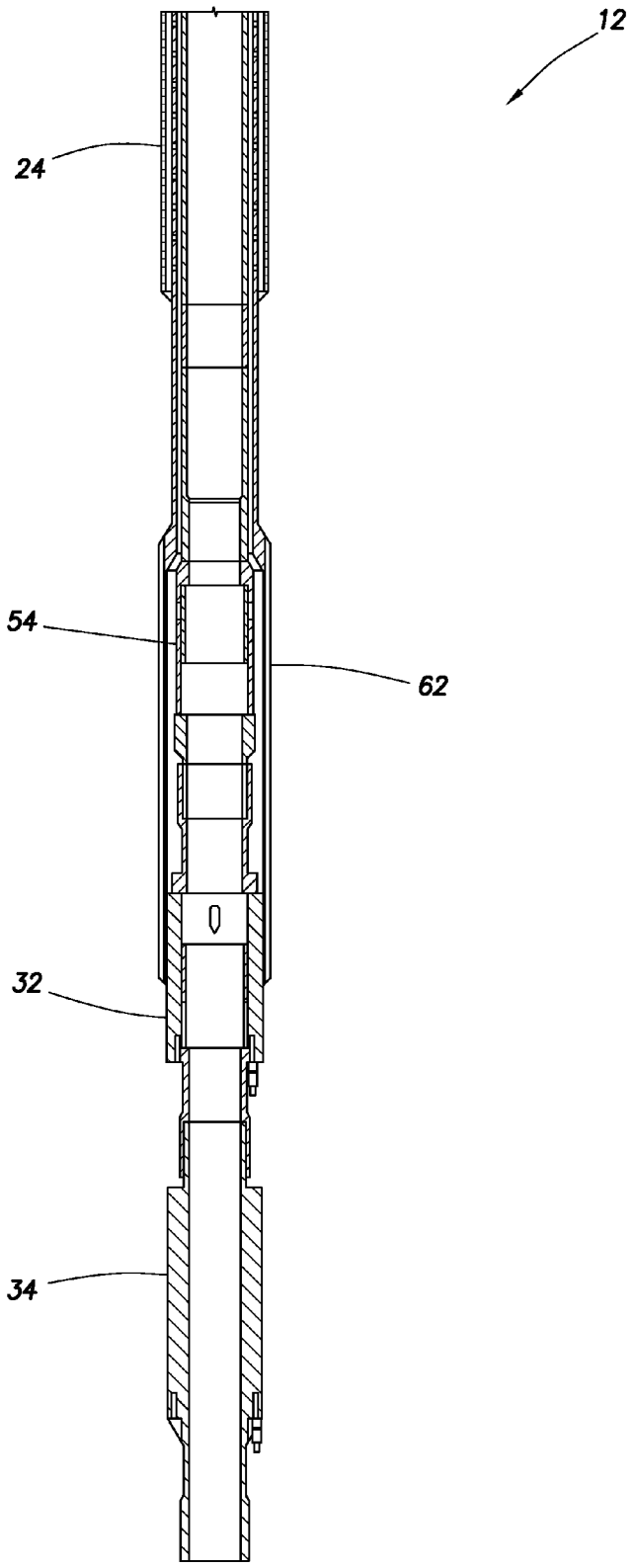

Referring additionally now to FIGS. 2A-C, an example of one longitudinal section of the completion string 12 is representatively illustrated. The illustrated section depicts how flow through the well screens 24 can be controlled effectively using the flow control devices 32. The section shown in FIGS. 2A-C may be used in the system 10 and completion string 12 of FIG. 1, or it may be used in other systems and/or completion strings.

In the FIGS. 2A-C example, three of the flow control devices 32 are used to variably restrict flow through six of the well screens 24. This demonstrates that any number of flow control devices 32 and any number of well screens 24 may be used to control flow of the fluid 52 between a corresponding one of the zones 28 and the completion string 12. The scope of this disclosure is not limited to any particular number or combination of the various components of the completion string 12.

Another flow control device 54 (such as, a mechanically actuated sliding sleeve-type valve, etc.) may be used to selectively permit and prevent substantially unrestricted flow through the well screens 24. For example, during gravel packing operations, it may be desired to allow unrestricted flow through the well screens 24, for circulation of slurry fluid back to the earth's surface. In fracturing or other stimulation operations, the flow control device 54 can be closed to thereby prevent flow through the screens 24, so that sufficient pressure can be applied external to the screens to force fluid outward into the corresponding zone 28.

An upper one of the hydraulic control devices 34 is used to control operation of an upper one of the flow control devices 32 (FIG. 2A), and to control an intermediate one of the flow control devices (FIG. 2B). A lower one of the hydraulic control devices 34 is used to control actuation of a lower one of the flow control devices 32 (FIG. 2C).

If the SCRAMS™ device mentioned above is used for the hydraulic control devices 34, signals transmitted via the electrical lines 50 are used to control application of hydraulic pressure from the hydraulic lines to a selected one of the flow control devices 32. Thus, the flow control devices 32 can be individually actuated using the hydraulic control devices 34.

In FIG. 2A, it may be seen that an inner tubular 60 is secured to an outer tubular 94 (for example, by means of threads, etc.), so that the inner tubular 60 can be used to support a weight of a remainder of the completion string 12 below.

Figure 3:
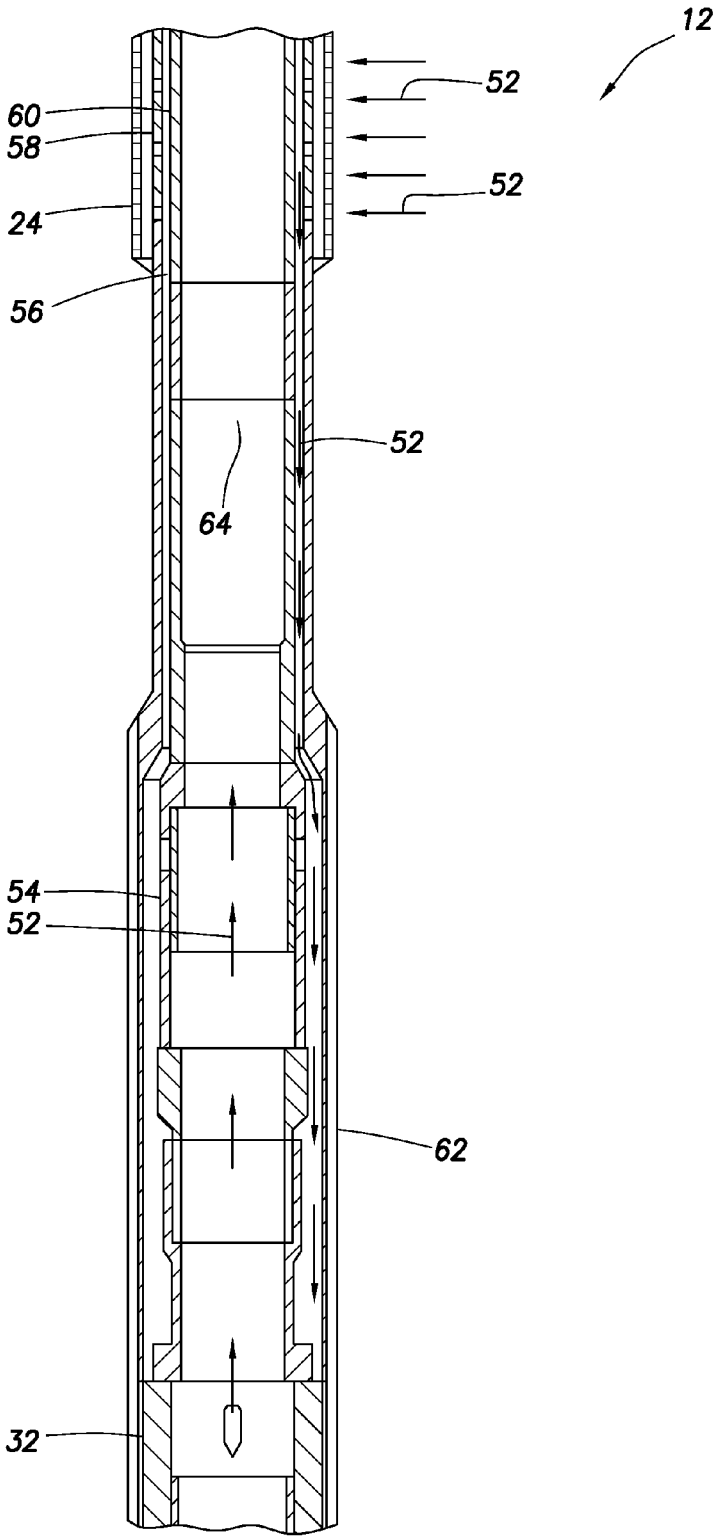
FIG. 3 is a representative cross-sectional view of a section of the completion string, with fluid flowing from an earth formation into the completion string.

Referring additionally now to FIG. 3, an example of how the flow control device 32 can be used to control flow of the fluid 52 through the well screen 24 is representatively illustrated. In this view, it may be seen that the fluid 52 enters the well screen 24 and flows into an annular area 56 formed radially between a perforated base pipe 58 of the well screen and an inner tubular 60. The fluid 52 flows through the annular area 56 to the flow control device 32, which is contained within an outer tubular shroud 62.

The flow control device 32 variably restricts the flow of the fluid 52 from the annular area 56 to a flow passage 64 extending longitudinally through the completion string 12. Such variable restriction may be used to balance production from the multiple zones 28, to prevent water or gas coning, etc. Of course, if the fluid 52 is injected into the zones 28, the variable restriction may be used to control a shape or extent of a water or steam flood front in the various zones, etc.

Figure 4:
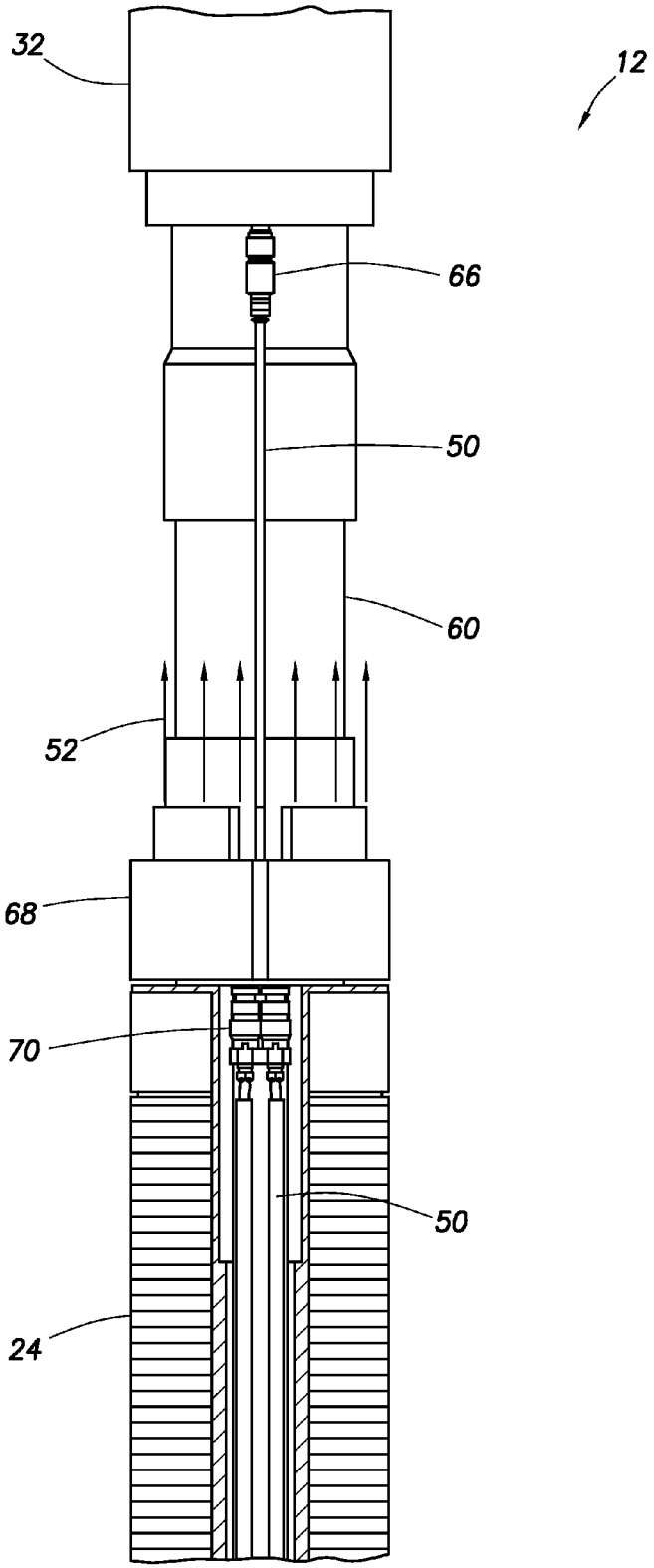
FIG. 4 is a representative elevational view of another section of the completion string.

Referring additionally now to FIG. 4, a manner in which the lines 50 may be routed through the completion string 12 is representatively illustrated. In this view, the shroud 62 is removed, so that the lines 50 extending from one of the flow control devices 32 (such as, the intermediate flow control device depicted in FIG. 2B) to a well screen 24 below the flow control device may be seen.

The lines 50 extend from a connector 66 on the flow control device 32 to an end connection 68 of the well screen 24, wherein the lines are routed to another connector 70 for extending the lines further down the completion string 12. The end connection 68 may be provided with flow passages (not shown) to allow the fluid 52 to flow longitudinally through the end connection from the well screen 24 to the flow control device 32 via the annular area 56. Casting the end connection 68 can allow for forming complex flow passage and conduit shapes in the end connection, but other means of fabricating the end connection may be used, if desired.

Figure 5:
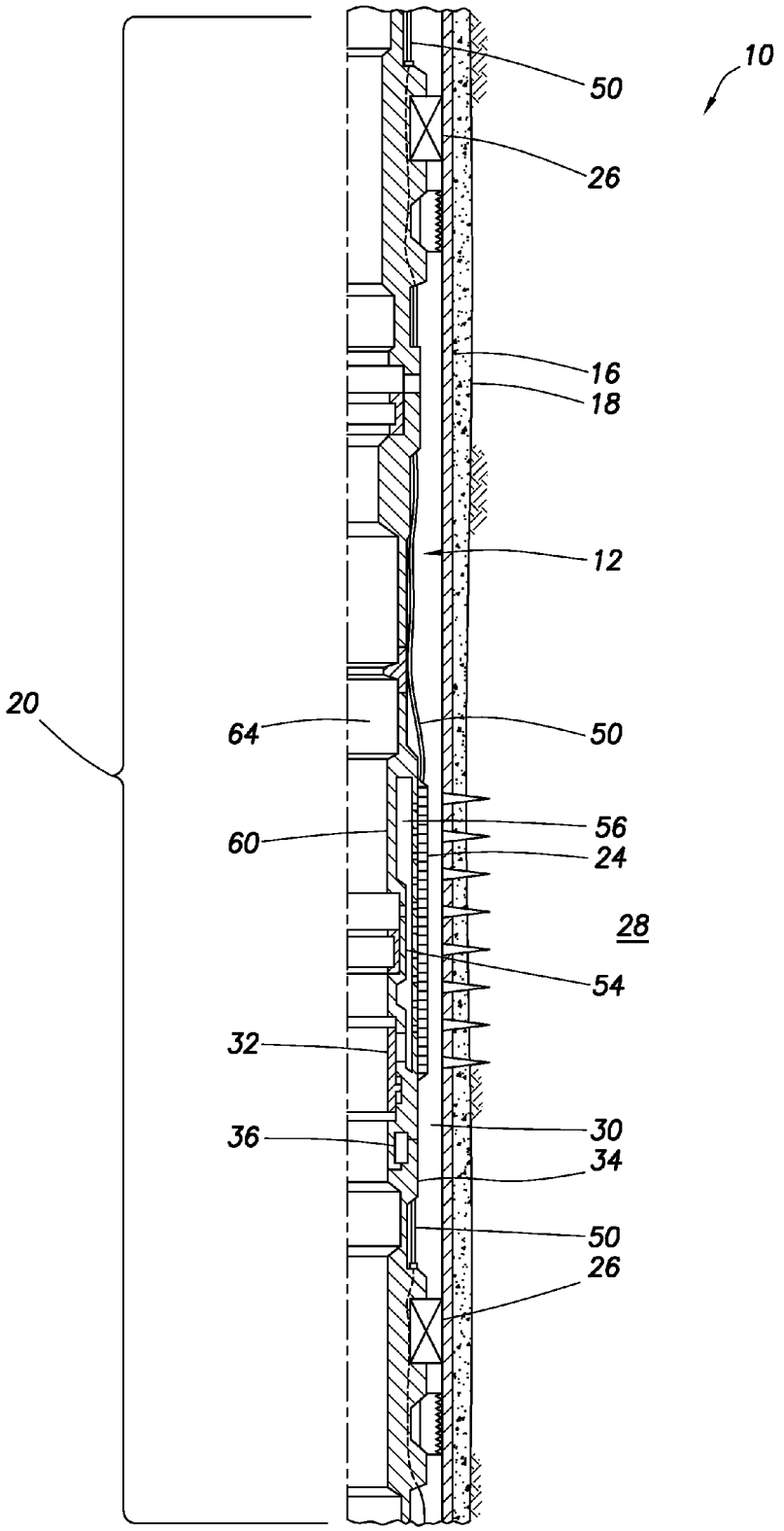
FIG. 5 is a representative cross-sectional view of another example of the well system and method.

Referring additionally now to FIG. 5, another example of the completion system 10 and completion string 12 is representatively illustrated. In this example, the set 20 of completion equipment includes only one each of the well screen 24, flow control device 32, hydraulic control device 34 and flow control device 54. However, as mentioned above, any number or combination of components may be used, in keeping with the scope of this disclosure.

One difference in the FIG. 5 example is that the flow control device 54 and at least a portion of the flow control device 32 are positioned within the well screen 24. This can provide a more longitudinally compact configuration, and eliminate use of the shroud 62. Thus, it will be appreciated that the scope of this disclosure is not limited to any particular configuration or arrangement of the components of the completion string 12.

In addition, it can be seen in FIG. 5 that the hydraulic control device 34 can include the pressure sensor 36, which can be ported to the interior flow passage 64 and/or to the annulus 30 external to the completion string 12. Multiple pressure sensors 36 may be provided in the hydraulic control device 34 to separately sense pressures internal to, or external to, the completion string 12.

Figure 6:
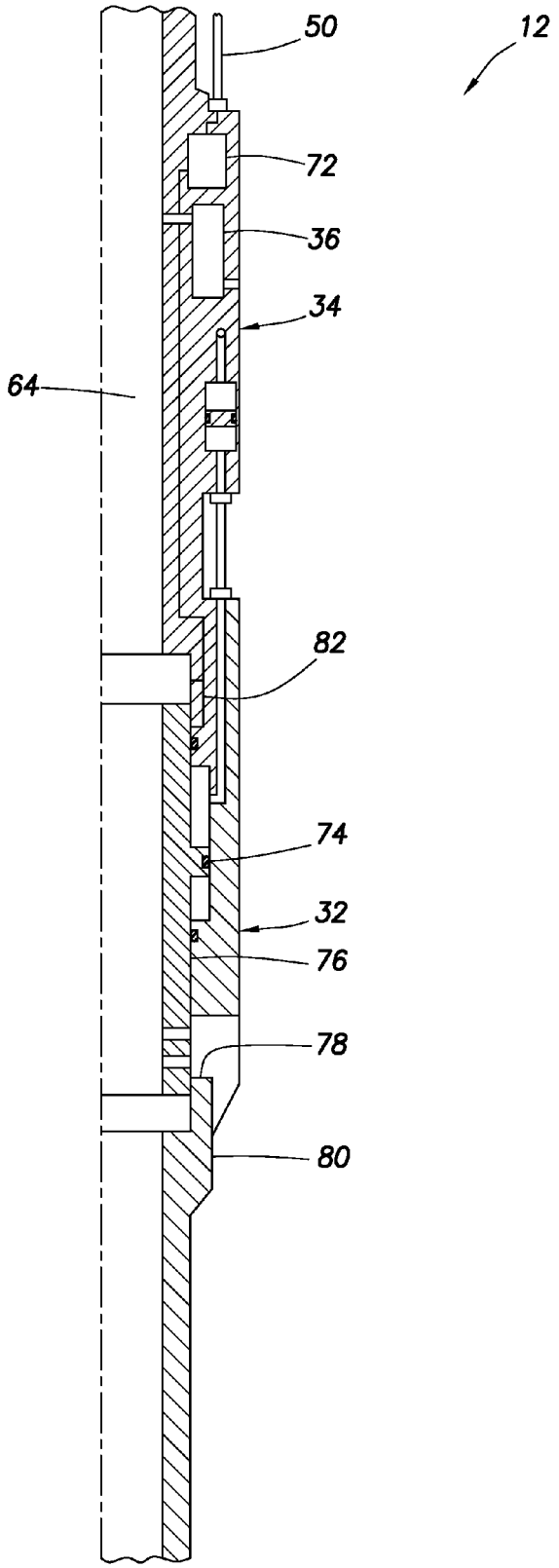
FIG. 6 is a representative cross-sectional view of a flow control device which may be used in the well system and method.

Referring additionally now to FIG. 6, another example of how the flow control device 32 may be connected to the hydraulic control device 34 is representatively illustrated. In this example, the hydraulic control device 34 includes electronics 72 (such as, one or more processors, memory, batteries, etc.) responsive to signals transmitted from a remote location (for example, a control station at the earth's surface, a sea floor installation, a floating rig, etc.) via the lines 50 to direct hydraulic pressure (via a hydraulic manifold, not shown) to an actuator 74 of the flow control device 32.

The FIG. 6 flow control device 32 includes a sleeve 76 which is displaced by the actuator 74 relative to an opening 78 in an outer housing 80, in order to variably restrict flow through the opening. Preferably, the flow control device 32 also includes a position indicator 82, so that the electronics 72 can verify whether the sleeve 76 is properly positioned to obtain a desired flow restriction. The pressure sensor(s) 36 may be used to verify that a desired pressure differential is achieved across the flow control device 32.

Referring additionally now to FIG. 7, a manner in which a wet connection 84 can be made between the lines 48 on the production string 38 and the lines 50 on the completion string 12 is representatively illustrated. In this example, the wet connection 84 is made above the uppermost packer 26, but in other examples the wet connection could be made within the packer, below the packer, or in another location.

As depicted in FIG. 7, a wet connector 86 on the production string 38 is axially engaged with a wet connector 88 on the completion string 12 when the seals 40 are stabbed into the seal bore 42. Although only one set is visible in FIG. 7, the wet connection 84 preferably includes connectors 86, 88 for each of electrical, hydraulic and optical connections between the lines 48, 50.

However, it is not necessary for all of the electrical, hydraulic and optical wet connections to be made by axial engagement of connectors 86, 88. For example, radially oriented hydraulic connections can be made by use of longitudinally spaced apart seals and ports on the production string 38 and completion string 12. As another example, an electrical wet connection could be made with an inductive coupling. Thus, the scope of this disclosure is not limited to use of any particular type of wet connectors.

Figure 8:
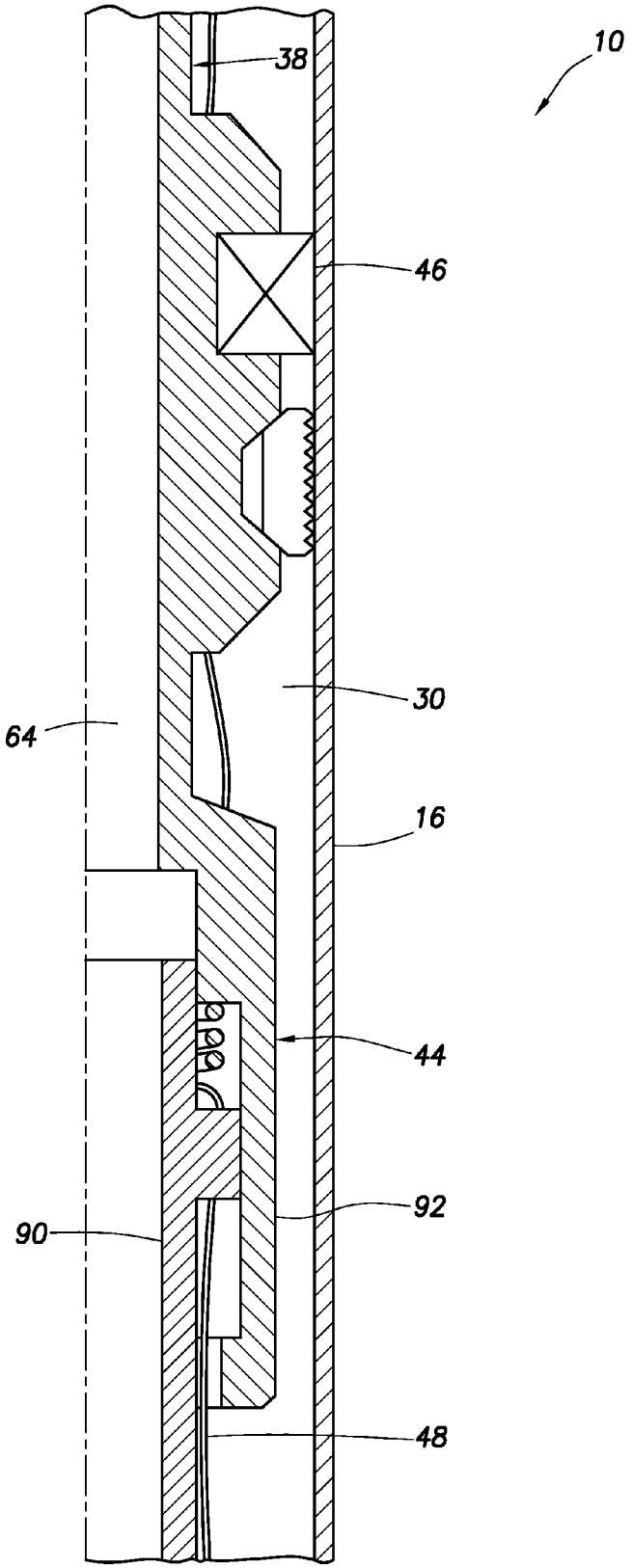
FIG. 8 is a representative cross-sectional view of an expansion joint which may be used in the well system and method.

Referring additionally now to FIG. 8, a manner in which the lines 48 may be extended through the expansion joint 44 in the system 10 is representatively illustrated. In this view, it may be seen that the lines 48 (preferably including electrical, hydraulic and optical lines) are coiled between an inner mandrel 90 and an outer housing 92 of the expansion joint 44.

However, note that use of the expansion joint 44 is not necessary in the system 10. For example, a spacing between the uppermost packer 26 and a tubing hanger seat in the wellhead (not shown) could be accurately measured, and the production string 38 could be configured correspondingly, in which case the packer 46 may not be used on the production string.

Although the flow control device 32 in the above examples is described as being a remotely hydraulically actuated variable choke, any type of flow control device which provides a variable resistance to flow may be used, in keeping with the scope of this disclosure. For example, a remotely actuated inflow control device may be used. An inflow control device may be actuated using the hydraulic control device 34 described above, or relatively straightforward hydraulic control lines may be used to actuate an inflow control device.

Alternatively, an autonomous inflow control device (one which varies a resistance to flow without commands or actuation signals transmitted from a remote location), such as those described in US Publication Nos. 2011/0042091, 2011/0297385, 2012/0048563 and others, may be used.

Use of an inflow control device (autonomous or remotely actuated) may be preferable for injection operations, for example, if precise regulation of flow resistance is not required. However, it should be appreciated that the scope of this disclosure is not limited to use of any particular type of flow control device, or use of a particular type of flow control device in a particular type of operation.

Alternatively, a remotely operable sliding sleeve valve which opens on command from the surface could be utilized. An opening signal could be conveyed by electric control line, or the signal could be sent from the surface down the tubing, e.g., via HALSONICS™ pressure pulse telemetry, an ATS™ acoustic telemetry system, DYNALINK™ mud pulse telemetry system, an electromagnetic telemetry system, etc. The sliding sleeve valve could have a battery, a sensor, a computer (or at least a processor and memory), and an actuation system to open on command.

Instead of, or in addition to, the pressure sensors 36, separate pressure and/or temperature sensors may be conveyed into the completion string 12 during the method described above, in which characteristics and flow paths of the fluid 52 flowing between the completion string and the individual zones 28 are determined. For example, a wireline or coiled tubing conveyed perforated dip tube could be conveyed into the completion string during or prior to performance of the method.

It may now be fully appreciated that the above disclosure provides significant advancements to the art of constructing and operating well completion systems. In examples described above, enhanced well diagnostics are made possible by use of a selectively variable flow control device 32 integrated with an optical sensor (e.g., an optical waveguide as part of the lines 50) external to the completion string 12, and pressure sensors 36 ported to an interior and/or exterior of the completion string.

A system 10 for use with a subterranean well having multiple earth formation zones 28 is provided to the art by the above disclosure. In one example, the system 10 can include: multiple well screens 24 which filter fluid 52 flowing between a completion string 12 in the well and respective ones of the multiple zones 28; at least one optical waveguide 50 which senses at least one property of the fluid 52 as it flows between the completion string 12 and at least one of the zones 28; multiple flow control devices 32 which variably restrict flow of the fluid 52 through respective ones of the multiple well screens 24; and multiple pressure sensors 36 which sense pressure of the fluid 52 which flows through respective ones of the multiple well screens 24.

The multiple well screens 24, the optical waveguide 50, the multiple flow control devices 32, and the multiple pressure sensors 36 can be installed in the well in a single trip into the well.

The system 10 can also include multiple hydraulic control devices 34 which control application of hydraulic actuation pressure to respective ones of the multiple flow control devices 32.

A single one of the hydraulic control devices 34 may control application of hydraulic actuation pressure to multiple ones of the flow control devices 32.

The pressure sensors 36 may sense pressure of the fluid 52 external and/or internal to the completion string 12.

The flow control devices 32 may comprise remotely hydraulically actuated variable chokes. The flow control devices 32 may comprise autonomous variable flow restrictors.

The flow control devices 32, in some examples, receive the fluid 52 from the respective ones of the multiple well screens 24.

The system 10 may include a combined hydraulic, electrical and optical wet connection 84.

The system 10 may include an expansion joint 44 with hydraulic, electrical and optical lines 48 traversing the expansion joint 44.

The optical waveguide 50 can be positioned external to the well screens 24. The optical waveguide 50 can be positioned between the well screens 24 and the zones 28.

Also described above is a completion string 12 for use in a subterranean well. In one example, the completion string 12 can include at least one well screen 24; at least one first flow control device 54; and at least one second flow control device 32, the second flow control device 32 being remotely operable. The first flow control device 54 selectively prevents and permits substantially unrestricted flow through the well screen 24. The second flow control device 32 variably restricts flow through the well screen 24.

The completion string 12 can include a hydraulic control device 34 which controls application of hydraulic actuation pressure to the second flow control device 32.

The second flow control device 32 may comprise multiple second flow control devices 32, and the hydraulic control device 34 may control application of hydraulic actuation pressure to the multiple second flow control devices 32.

The completion string 12 can include at least one optical waveguide 50 which is operative to sense at least one property of a fluid 52 which flows through the well screen 24.

A method of operating a completion string 12 in a subterranean well is also described above. In one example, the method can comprise: closing all of multiple flow control devices 32 connected in the completion string 12, the completion string 12 including multiple well screens 24 which filter fluid 52 flowing between the completion string 12 and respective ones of multiple earth formation zones 28, at least one optical waveguide 50 which senses at least one property of the fluid 52 as it flows between the completion string 12 and at least one of the zones 28, the multiple flow control devices 32 which variably restrict flow of the fluid 52 through respective ones of the multiple well screens 24, and multiple pressure sensors 36 which sense pressure of the fluid 52 which flows through respective ones of the multiple well screens 24; at least partially opening a first selected one of the flow control devices 32; and measuring a first change in the property sensed by the optical waveguide 50 and a first change in the pressure of the fluid 52 as a result of the opening of the first selected one of the flow control devices 32.

The method can also include: closing all of the multiple flow control devices 32 after the step of at least partially opening the first selected one of the flow control devices 32; at least partially opening a second selected one of the flow control devices 32; and measuring a second change in the property sensed by the optical waveguide 50 and a second change in the pressure of the fluid 52 as a result of the opening of the second selected one of the flow control devices 32.

The method can include installing the multiple well screens 24, the optical waveguide 50, the multiple flow control devices 32, and the multiple pressure sensors 36 in the well in a single trip into the well.

The method can include closing all of the flow control devices 32, thereby preventing inadvertent flow of the fluid 52 into the completion string 12. This step can be useful in a well control situation.

The method can include closing all of the flow control devices 32, thereby preventing inadvertent flow of the fluid 52 out of the completion string 12. This step can be useful in preventing loss of the fluid 52 to the surrounding zones 28.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of operating a completion string in a subterranean well, the method comprising:

coupling a production string to the completion string, wherein a first control line is carried on the production string and a second control line is carried on the completion string;

wherein a wet connection is made between the first control line and the second control line;

closing a first flow control device and a second flow control device connected in the completion string, the completion string including a first well screen and a second well screen which filter fluid flowing between the completion string and respective ones of a first earth formation zone and a second earth formation zone, wherein a hydraulic control device controls operation of the first flow control device and the second flow control device to variably restrict flow of the fluid through respective ones of the first well screen and the second well screen, wherein the hydraulic control device is disposed within the completion string and wherein the hydraulic control device controls operation of the first flow control device and the second flow control device using a signal transmitted to the hydraulic control device via the first control line and the second control line, and wherein multiple pressure sensors sense pressure of the fluid which flows through respective ones of the first well screen and the second well screen;

at least partially opening the first flow control device using the hydraulic control device while the second flow control device remains closed;

measuring a first change in the pressure of the fluid as a result of the opening of the first flow control device; and detecting properties of a fluid flowing between the first earth formation zone and the completion string through the first well screen.

2. The method of claim 1, wherein at least one of the first flow control device and the second flow control device comprises an autonomous variable flow restrictor.

3. The method of claim 1, wherein the completion string further comprises a combined hydraulic, electrical and optical wet connection.

4. The method of claim 1, wherein the completion string further comprises an expansion joint with hydraulic, electrical and optical lines traversing the expansion joint.

5. The method of claim 1, wherein at least one of the first flow control device and the second flow control device comprises a remotely hydraulically actuated variable choke.

6. The method of claim 1, wherein the completion string further comprises at least one optical waveguide which senses at least one property of the fluid as it flows between the completion string and at least one of the first earth formation zone and the second earth formation zone, the method further comprising measuring a first change in the property sensed by the optical waveguide.

7. The method of claim 1, further comprising:

closing the first flow control device;

at least partially opening the second flow control device using the hydraulic control device while the first flow control device remains closed;

measuring a second change in the pressure of the fluid as a result of the opening of the second flow control device;

detecting properties of a fluid flowing between the second earth formation zone and the completion string through the second well screen.

8. A method of operating a completion string in a subterranean well, the method comprising:

coupling a production string to the completion string, wherein a first control line is carried on the production string and a second control line is carried on the completion string;

wherein a wet connection is made between the first control line and the second control line;

closing a first flow control device and a second flow control device connected in the completion string, the completion string including a first well screen and a second well screen which filter fluid flowing between the completion string and respective ones of a first earth formation zone and a second earth formation zone, wherein the first flow control device and the second flow control device variably restrict flow of the fluid through respective ones of the first well screen and the second well screen, wherein a hydraulic control device controls operation of the first flow control device and the second flow control device to variably restrict flow of the fluid through respective ones of the first well screen and the second well screen, wherein the hydraulic control device is disposed within the completion string and wherein the hydraulic control device controls operation of the first flow control device and the second flow control device using a signal transmitted to the hydraulic control device via the first control line and the second control line, and wherein multiple pressure sensors sense pressure of the fluid which flows through respective ones of the first well screen and the second well screen;

at least partially opening the first flow control device while the second flow control device remains closed;

measuring a first change in the pressure of the fluid as a result of the opening of the first flow control device, and selectively permitting and preventing substantially unrestricted fluid flow through at least one of the first well screen and the second well screen using a third flow control device, wherein the third flow control device is a mechanically actuated valve.

9. The method of claim 8, wherein at least one of the first flow control device and the second flow control device comprises a remotely hydraulically actuated variable choke.

10. The method of claim 8, wherein at least one of the first flow control device and the second flow control device comprises autonomous variable flow restrictors.

11. The method of claim 8, wherein the completion string further comprises a combined hydraulic, electrical and optical wet connection.

12. The method of claim 8, wherein the completion string further comprises an expansion joint with hydraulic, electrical and optical lines traversing the expansion joint.

13. The method of claim 8, wherein the completion string further comprises at least one optical waveguide which senses at least one property of the fluid as it flows between the completion string and at least one of the first earth formation zone and the second earth formation zone, the method further comprising measuring a first change in the property sensed by the optical waveguide.

14. The method of claim 8, further comprising:

closing the first flow control device;

at least partially opening the second flow control device using the hydraulic control device while the first flow control device remains closed;

measuring a second change in the pressure of the fluid as a result of the opening of the second flow control device;

detecting properties of a fluid flowing between the second earth formation zone and the completion string through the second well screen.

* * * * *